US010967942B2

(12) United States Patent
Choisnet

(10) Patent No.: US 10,967,942 B2
(45) Date of Patent: Apr. 6, 2021

(54) LAUNCHING METHOD

(71) Applicant: IDEOL, La Ciotat (FR)

(72) Inventor: Thomas Choisnet, Marseilles (FR)

(73) Assignee: IDEOL, La Ciotat (FR)

( * ) Notice: Subject to any disclaimer, the term of this patent is extended or adjusted under 35 U.S.C. 154(b) by 0 days.

(21) Appl. No.: 16/619,404

(22) PCT Filed: Jun. 6, 2018

(86) PCT No.: PCT/FR2018/051301
§ 371 (c)(1),
(2) Date: Dec. 4, 2019

(87) PCT Pub. No.: WO2018/224770
PCT Pub. Date: Dec. 13, 2018

(65) Prior Publication Data

US 2020/0115014 A1 Apr. 16, 2020

(30) Foreign Application Priority Data

Jun. 6, 2017 (FR) ..... 1754994

(51) Int. Cl.
*B63C 1/02* (2006.01)
*B66F 3/24* (2006.01)

(52) U.S. Cl.
CPC ..... *B63C 1/02* (2013.01); *B66F 3/24* (2013.01)

(58) Field of Classification Search
CPC ..... B63C 1/02; B66F 3/24
See application file for complete search history.

(56) References Cited

U.S. PATENT DOCUMENTS 2,352,370 A * 6/1944 Carruthers ..... E02B 17/00 405/204
3,138,932 A * 6/1964 Kofahl ..... E02B 17/021 405/209

(Continued)

FOREIGN PATENT DOCUMENTS

FR 1385516 A 1/1965
FR 2970696 B1 2/2013

(Continued)

OTHER PUBLICATIONS

International Search Report for Application No. PCT/FR2018/051301, dated Sep. 11, 2018 (3 pages), with English Translation (2 pages).

*Primary Examiner* — S. Joseph Morano
*Assistant Examiner* — Jovon E Hayes
(74) *Attorney, Agent, or Firm* — Bookoff McAndrews, PLLC

(57) ABSTRACT

The invention relates to the naval field and in particular to a method for launching a structure (1) intended to float in water (15). This method comprises loading the structure (1) onto a pontoon (10) floating in the water, the bearing placement below the water (15) of at least one prop (2) connected to the structure (1) while the structure (1) rests on the pontoon (10) floating in the water (15), lowering the pontoon (10), with disengagement of the pontoon (10) vertically from the structure (1) and its subsequent removal while the structure (1) is supported by the at least one prop (2) bearing below the water (15), and lowering the structure (1), which is still supported by the at least one prop (2), until the structure (1) floats in the water (15).

10 Claims, 10 Drawing Sheets

(56) References Cited

U.S. PATENT DOCUMENTS

| | | | | |
|---|---|---|---|---|
| 3,839,873 | A * | 10/1974 | Loire | E02B 17/027 405/208 |
| 4,276,849 | A | 7/1981 | Bloxham | |
| 7,419,329 | B1 | 9/2008 | Tafoya | |
| 2002/0000411 | A1* | 1/2002 | Rockwell | G06T 9/004 210/693 |
| 2008/0131209 | A1* | 6/2008 | Thomas | B63B 35/003 405/198 |
| 2011/0132250 | A1* | 6/2011 | Nelson | E04H 1/04 114/266 |
| 2017/0241408 | A1* | 8/2017 | Von Heland | B63B 35/44 |
| 2020/0115014 | A1* | 4/2020 | Choisnet | B63C 1/02 |

FOREIGN PATENT DOCUMENTS

| | | | |
|---|---|---|---|
| JP | S5559226 | A | 5/1980 |
| JP | S62152996 | A | 7/1987 |
| KR | 100642343 | B1 | 10/2006 |
| KR | 20090011697 | A | 2/2009 |
| SG | 181576 | A1 | 7/2012 |
| SU | 1030299 | A1 | 7/1983 |
| SU | 1273293 | A1 | 11/1986 |

* cited by examiner

LAUNCHING METHOD

CROSS REFERENCE TO RELATED APPLICATIONS

This application is the U.S. national phase entry under 35 U.S.C. § 371 of International Application No. PCT/FR2018/051301, filed on Jun. 6, 2018, which claims priority to French Patent Application No. 1754994, filed on Jun. 6, 2017.

BACKGROUND OF THE INVENTION

The present disclosure relates to the field of shipbuilding and more specifically to the field of launching structures intended to float in water.

The launching is a critical step after the construction or repair, on dry ground, of a structure intended to float in water such as, for example, a ship or a floating platform. This transition from a solid support onshore to floatation in water must normally be managed accurately to avoid damage to the launched structure. Those skilled in the art thus know, for example, the launching from an inclined plane, as described in the Japanese patent application publication JP S55-59226, the vertical launching using cranes or lifts, as described in the publications KR 2009 0011697, KR 10 0642343, FR 1 385 516, SG 181 576 or U.S. Pat. No. 7,419,329, and the launching in floodable dry dock. However, these methods generally require heavy, expensive and relatively uncommon infrastructures. Another alternative known to those skilled in the art is that of the immersion in a submersible barge, as described for example in the publications JP S62-152996 or U.S. Pat. No. 4,276,849. However, apart from the use of such a submersible barge, which is a complex and expensive equipment, this other alternative also requires a sufficient water depth to allow immersion of the barge at the location of the launching. However, at least in certain circumstances, it may be desirable to overcome at least partially such local constraints. For example, such freedom from local constraints in terms of infrastructure or water depth allows reducing the distance of towing floating structures intended to be anchored offshore, between the locations of their construction and launching, and their final location.

The Soviet inventor certificates SU 1030299 A and SU 1273293 A1 have disclosed methods for launching a floating platform which may include the steps of loading the platform on a pontoon floating in water, abutting under water support pillars connected to the platform while the latter rests on the pontoon floating in water, lifting the platform on the support pillars, removing the pontoon and lowering the platform, supported again by the support pillars, until the platform floats in water.

These methods however still require relatively heavy local infrastructures, in particular a subsea support to support the pontoon when loading the platform, as well as powerful lifting means to lift the platform on the support pillars in order to allow the removal of the pontoon.

OBJECT AND SUMMARY OF THE INVENTION

The present disclosure aims at overcoming these drawbacks, in particular by proposing a method for launching a structure intended to float in water that allows independence from local conditions, as well as from powerful lifting means.

This aim is achieved due to the fact that, according to at least a first aspect of this disclosure, this method, which can in particular comprise the steps of loading the structure on a pontoon floating in water, abutting under water at least one support pillar, connected to the structure, while the structure rests on the pontoon floating in water, removing the pontoon while the structure is supported by the at least one support pillar bearing under water, and lowering the structure, still supported by the at least one support pillar, until the structure floats in water, can further comprise a step of lowering the pontoon, vertically separating the pontoon from the structure, while the structure is supported by the at least one support pillar bearing under water and prior to the pontoon removal step.

Thanks to these dispositions, by lowering the pontoon, rather than raising the platform, it is possible to overcome both local conditions and the need for powerful lifting means to vertically separate the pontoon from the platform and thus allow the removal of the pontoon.

According to at least one additional aspect, the at least one support pillar can be removably connected to the structure, and the method can then also comprise a step of separating the at least one support pillar from the structure once the latter floats in water. It may thus be possible to reuse the at least one support pillar for the launching of other structures. Furthermore, the at least one support pillar can be connected to the structure through a location for the fastening of an anchor line on the structure. Thus, this location may offer a dual use, for the launching and subsequent anchoring of the structure after the launching of the latter.

According to at least another additional aspect, the method may also comprise a step of connecting the at least one support pillar to the structure before abutting under water the at least one support pillar.

According to yet another aspect, the pontoon can be lowered relative to its waterline during the pontoon lowering step. Particularly, the pontoon may be ballasted to carry out the pontoon lowering step. By thus lowering the pontoon in water, the pontoon can be easily vertically moved away from the structure supported by the at least one support pillar, provided that the pontoon does not already rest directly on the bottom of the water, in order to allow the subsequent removal of the pontoon.

However, alternatively or in addition to this lowering of the pontoon relative to its waterline, it is also conceivable that the water level will go down during the pontoon lowering step. Particularly, the water level can be lowered by the tide during the lowering of the pontoon. It is thus possible to make use of the natural phenomenon of the tides, rather than of complex devices or facilities, in order to vertically move away the pontoon from the structure supported by the at least one support pillar, so as to allow its subsequent removal.

According to yet another additional aspect, a vertical hydraulic and/or mechanical actuating cylinder can be interposed between the at least one support pillar and the structure to thereby actuate a relative vertical displacement of the support pillar relative to the structure.

According to yet another additional aspect, the structure may be a floating platform, such as for example a floating drilling or exploration platform or a floating platform for harnessing renewable energies with at least one wind turbine or marine turbine.

BRIEF DESCRIPTION OF THE DRAWINGS

The invention will be better understood and its advantages will become more apparent upon reading the detailed following description of exemplary embodiments represented by way of non-limiting examples. The description refers to the appended drawings wherein.

DETAILED DESCRIPTION OF THE INVENTION

Figure 1:
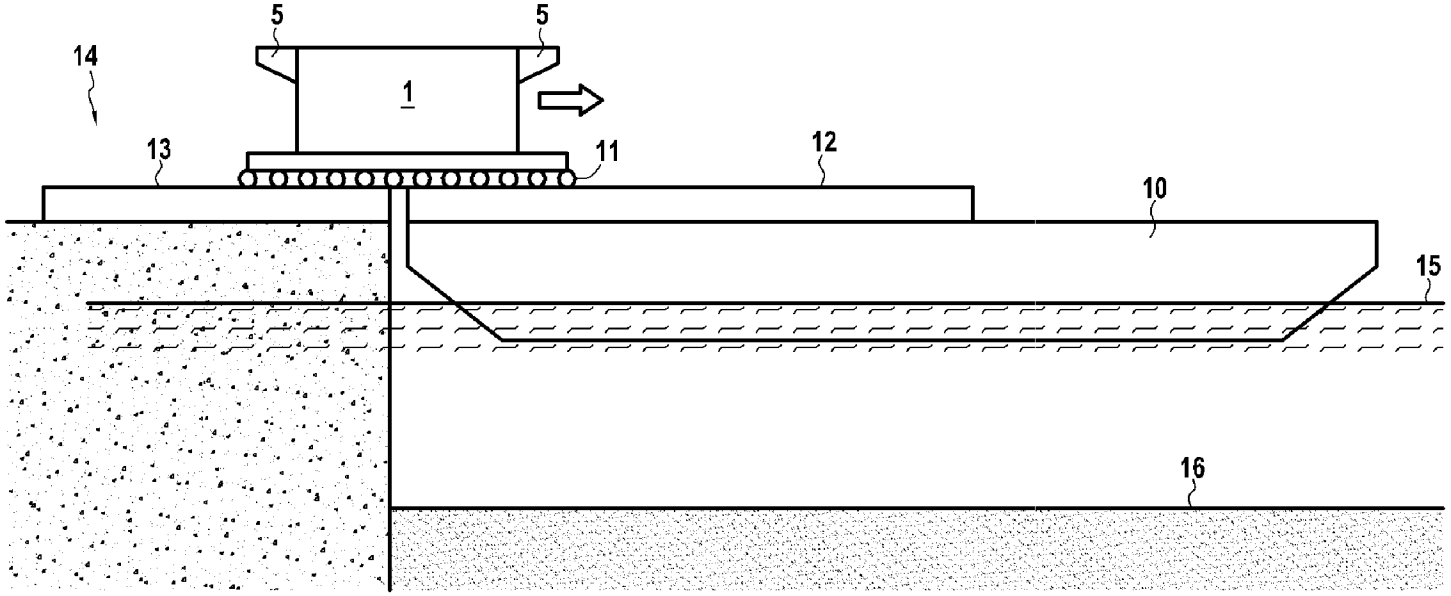
FIG. 1 is a schematic illustration of a first step of a launching method according to one aspect of the disclosure.

The steps of a method for launching a structure 1 according to one aspect of the present disclosure are illustrated in FIGS. 1 to 8. The structure 1 may be, as in the example illustrated, a floating platform as the one disclosed in document FR 2 970 696 B1, but could alternatively be for example a ship. It may have been assembled and/or built on-site, for example from modules prefabricated off-site and conveyed on-site. In a first step illustrated in FIG. 1, it is possible to carry out the loading of the structure 1 on a pontoon 10. Its loading can be carried out, as illustrated, on wheels or rollers 11, possibly placed on rails. For this, a surface for loading 12 the pontoon 10 can be at substantially the same level, in this first step, as the surface 13 of the ground at the adjacent shore 14, from which the structure 1 is loaded.

Figure 2:
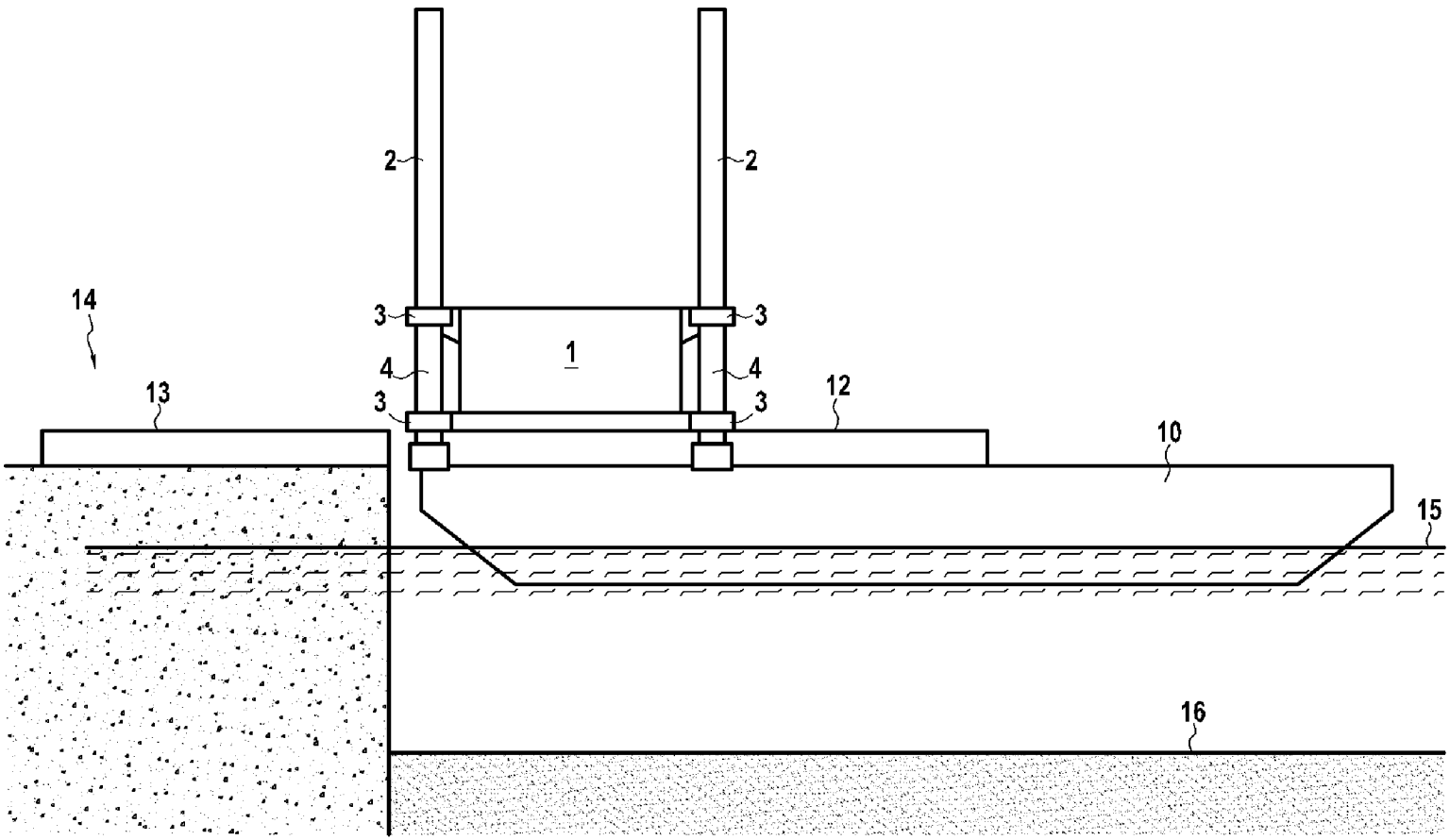
FIG. 2 is a schematic illustration of a second step of the same launching method.

Once the structure 1 is loaded, it is possible, in a second step illustrated in FIG. 2, to connect support pillars 2 to the structure 1. Alternatively, however, the connection of the support pillars 2 to the structure 1 could be carried out before the loading of the structure, with the support pillars 2 already installed, on the pontoon 10. These support pillars 2 can be connected to the structure 1 by fasteners 3, which can be removably fastened, for example, to locations 5 for the fastening of the anchor lines on this structure 1.

Figure 10A:
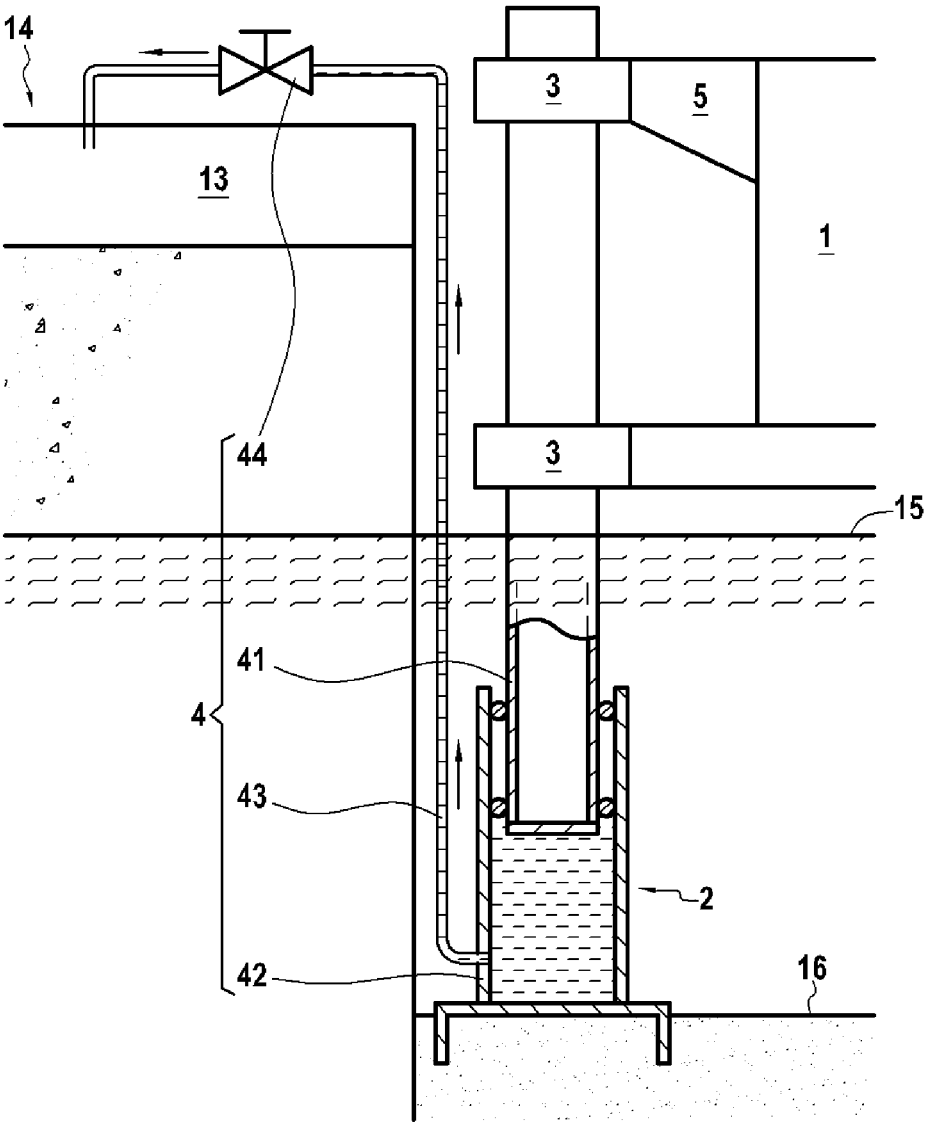
FIG. 10A schematically illustrates a cylinder for use in the above-mentioned method.
Figure 10B:
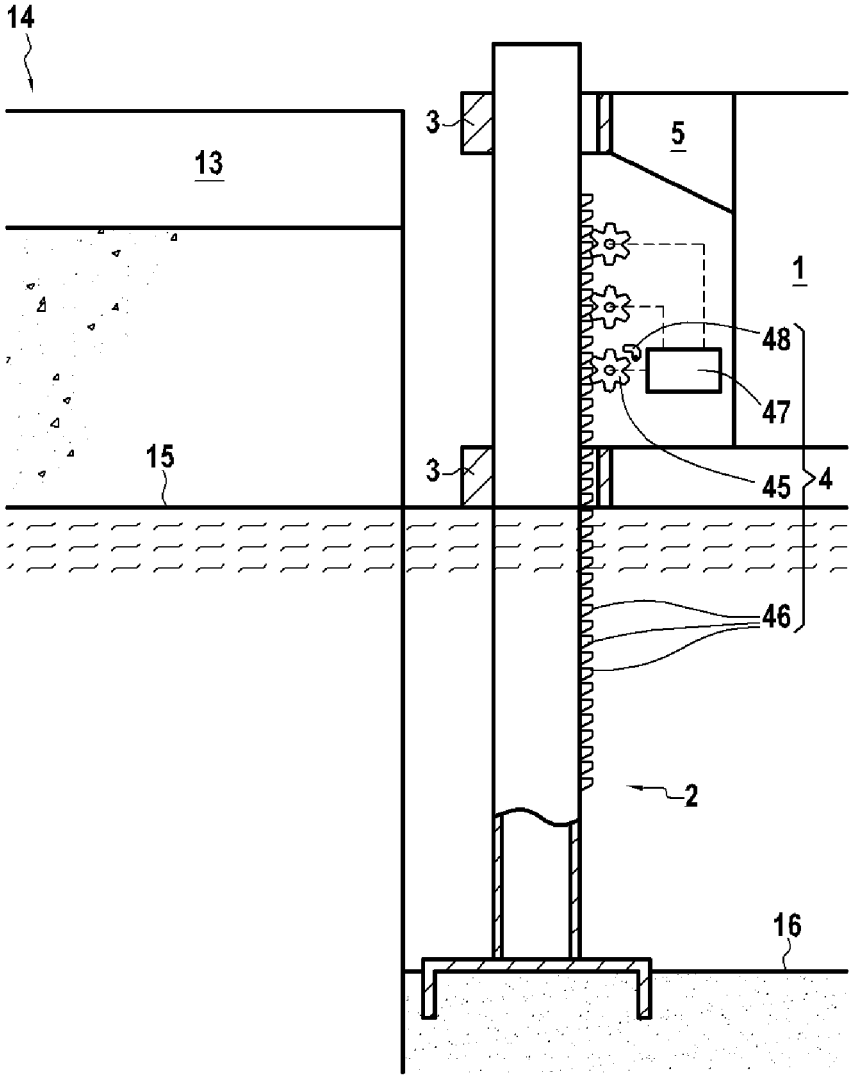
FIG. 10B schematically illustrates an alternative cylinder for use in the above-mentioned method.

The support pillars 2 may be movable at least vertically relative to the fasteners 3. In order to actuate and/or brake their vertical motion, cylinders 4 may be interposed between the fasteners 3 and the support pillars 2. The cylinders 4 may be hydraulic cylinders, and in particular water cylinders, as illustrated for example in FIG. 10A, with a piston 41 secured to the fastener 3 slidably received in a cylinder 42 formed in the support pillar 2 and able to receive and discharge pressure water through a duct 43, with possibly restricted flow and able to be equipped with a valve 44 that can be opened to allow the passage of water in either direction in order to raise or lower the pillar support 2 relative to the fastener 3 or closed to fasten the position of the support pillar 2 relative to the fastener. Alternatively, however, the cylinders 4 may be mechanical cylinders, each comprising for example, as illustrated in FIG. 10B, one or more pinion(s) 45, associated with one of the fastener 3 and the support pillar 2, and a rack 46, associated with the other of the fastener 3 and the support pillar 2. The pinions 45 can be coupled to at least one motor 47 and a brake 48 to respectively actuate or brake or even block a relative vertical motion of the pillar support 2 compared to the fastener.

Figure 3:
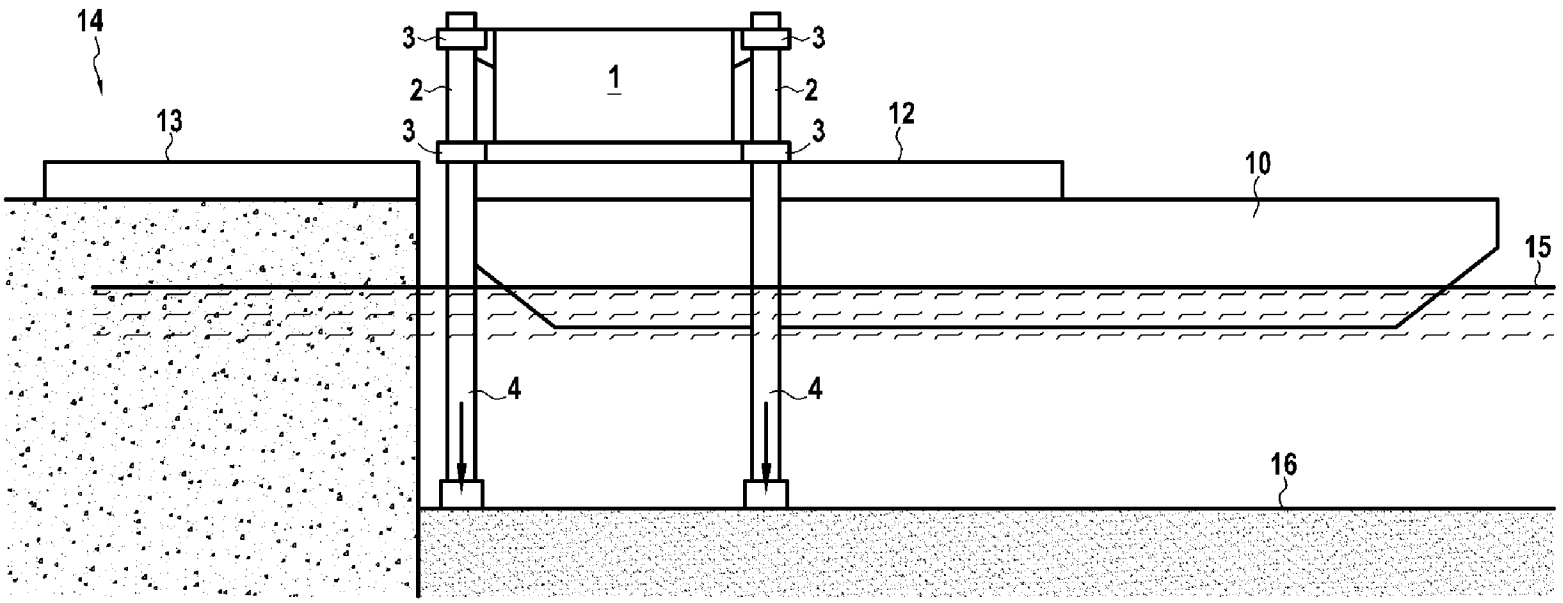
FIG. 3 is a schematic illustration of a third step of the same launching method.
Figure 4A:
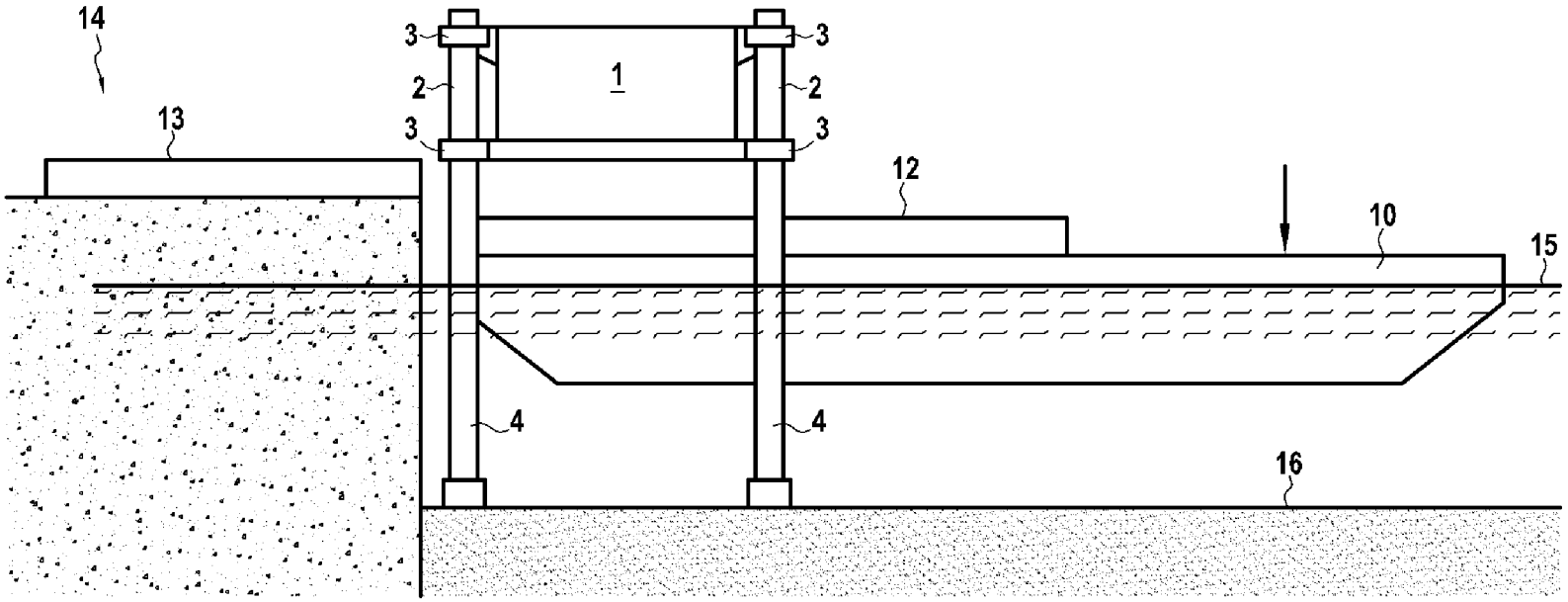
FIG. 4A is a schematic illustration of a fourth step of the same launching method, according to a first option.
Figure 4B:
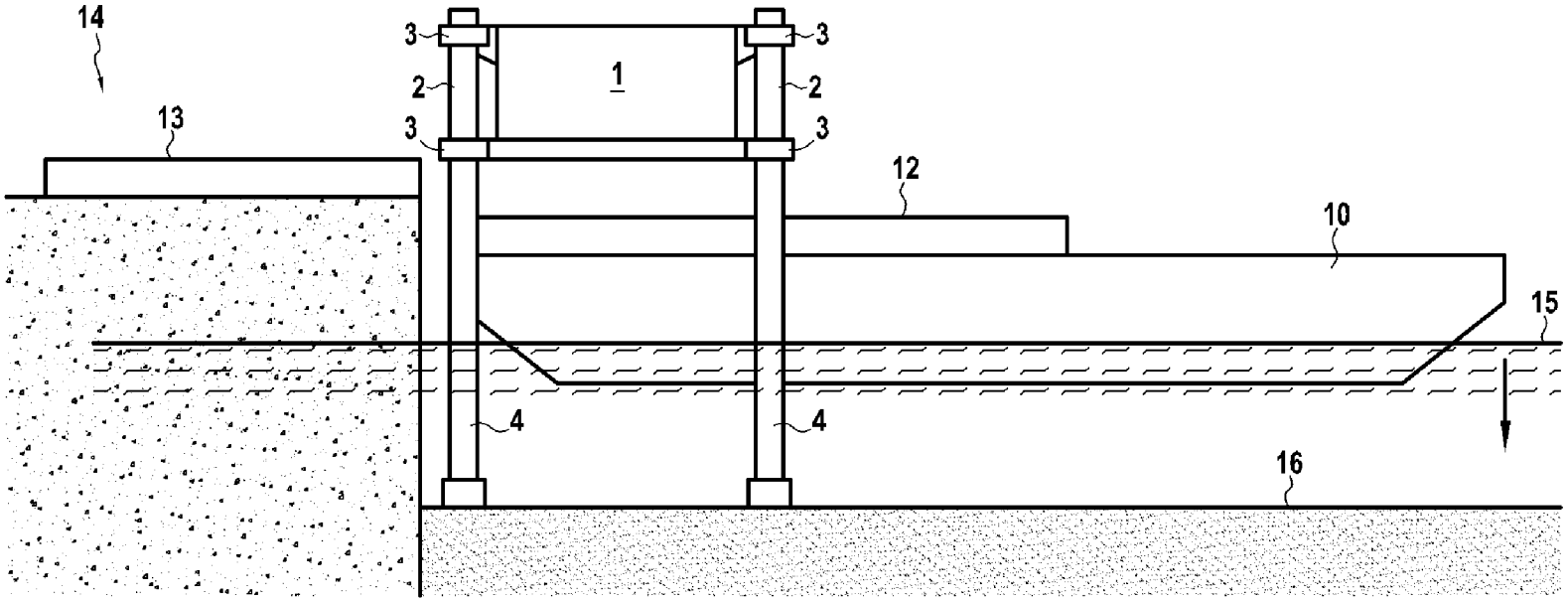
FIG. 4B is a schematic illustration of the fourth step of the same launching method, according to a second option.

Thus, in a third step, illustrated in FIG. 3, it is possible to lower the support pillars 2 until they abut under water 15 on the seabed 16. This lowering can simply be driven by gravity, or actuated by the cylinders 4, but in any case its speed can be restricted through these cylinders 4. Once the support pillars 2 abut under water 15, their relative position relative to the fasteners 3 and therefore relative to the structure 1 can be fastened, for example by blocking the cylinders 4, so that the bearing of the support pillars 2 under water 15 can support the structure 1.

In a fourth step, the pontoon 10 can be lowered under the structure 1, now supported, through the fasteners 3, by the support pillars 2 bearing under water 15, so as to vertically move away the pontoon 10 from the structure. According to a first aspect, illustrated by one example in FIG. 4A, in this fourth step, the pontoon 10 can be lowered relative to its waterline 17. This can be done for example by ballasting the pontoon 10, with solid or liquid ballast, so as to enhance its displacement. According to a second aspect, illustrated by one example in FIG. 4B, in this fourth step, the water 15 level goes down, so as to lower the pontoon 10 even if its level relative to its waterline 17 is maintained. This lowering of the water level can be achieved by a set of locks, but also, in a simpler manner and without resorting to particular infrastructures, it can be the effect of the tides: the support pillars 2 could therefore be lowered and abut under water 15 during high tide, and the pontoon 10 could go down and vertically move away from the structure 1 due to the low tide. Of course, these two aspects are not mutually exclusive, and it would also be possible to combine them, for example by ballasting the pontoon 10 to increase its descent because of the tide.

Figure 5:
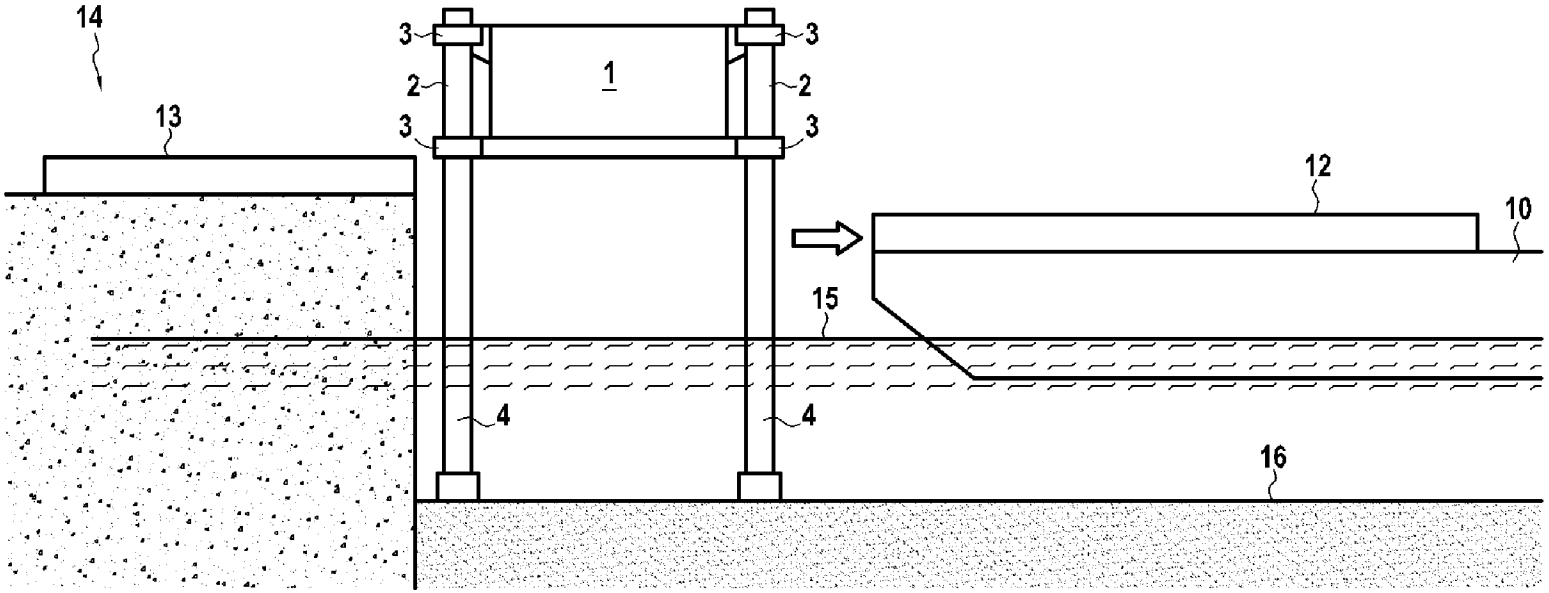
FIG. 5 is a schematic illustration of a fifth step of the same launching method.
Figure 6:
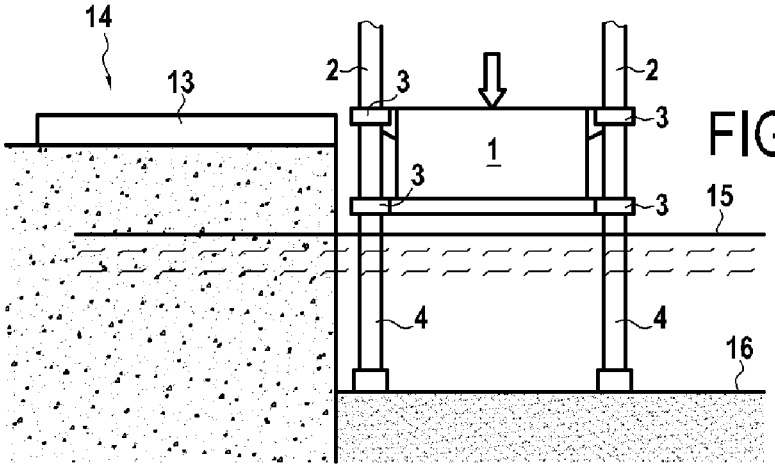
FIG. 6 is a schematic illustration of a sixth step of the same launching method.
Figure 7A:
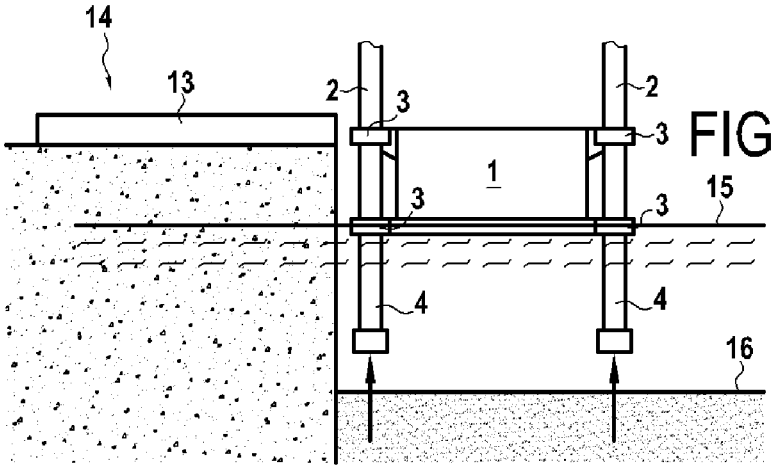
FIG. 7A is a schematic illustration of a seventh step of the same launching method, according to a first option.
Figure 7B:
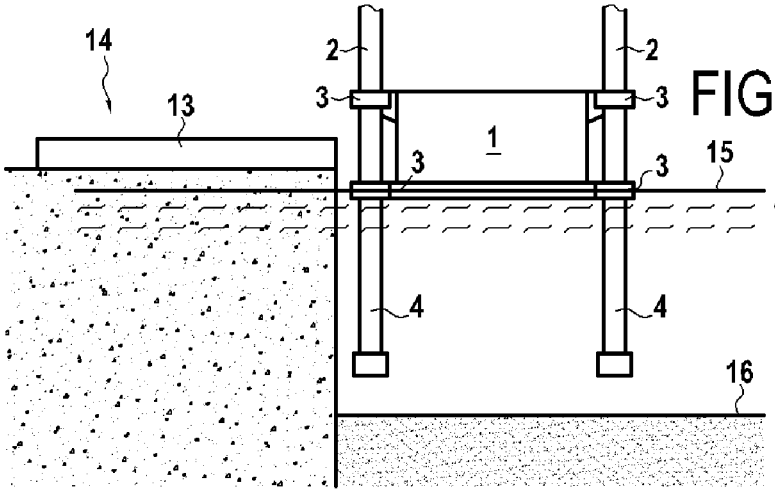
FIG. 7B is a schematic illustration of the seventh step of the same launching method, according to a second option.

Once a sufficient vertical gap is achieved between the pontoon 10 and the structure 1, now supported by the support pillars 2, it is possible to proceed to a fifth step, as in the example illustrated in FIG. 5, in which the pontoon 10 is removed. The space under the pontoon 10 being thus released, it is then possible to proceed to a sixth step, as in the example illustrated in FIG. 6, in which the structure 1 is lowered until it floats in water 15. As the lowering of the support pillars 2, this lowering of the structure 1 can be at least partially driven by gravity, or actuated by the cylinders 4, but in any case its speed can be restricted through these cylinders 4. Furthermore, this sixth step can be followed by a seventh step, as in the example illustrated in FIG. 7A, in which the support pillars 2 can still be raised higher relative to the structure 1, for example by using the cylinders 4, so as to disengage the support pillars 2 from the seabed 16 and thus allow the free floatation of the structure 1 while facilitating a subsequent separation of the support pillars 2 from the structure 1. However, alternatively or in combination with this raising of the support pillars 2 relative to the structure, a rise in the level of the water 15, for example due to the return of the high tide, can also serve to disengage the support pillars 2 relative to the seabed 16, as in the example illustrated in FIG. 7B.

Figure 8:
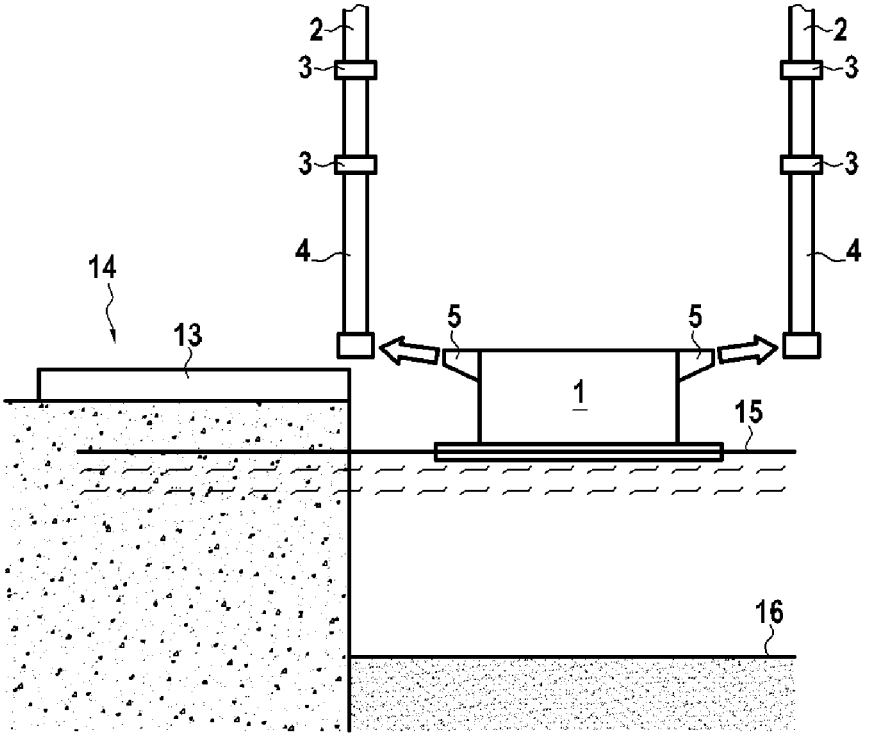
FIG. 8 is a schematic illustration of an eighth step of the same launching method.
Figure 9:
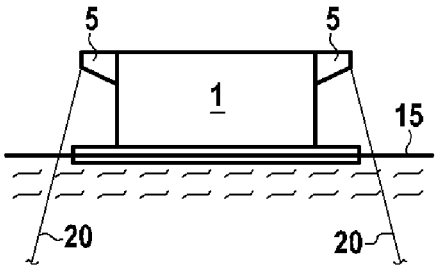
FIG. 9 is a schematic illustration of a structure anchored offshore after launching thereof according to the above-mentioned method.

Once the structure 1 floats in water 15 and the support pillars 2 are disengaged from the seabed 16, it is possible to proceed to an eighth step, as in the example illustrated in FIG. 8, in which the fasteners 3 can be detached from the structure 1, and the support pillars 2 be separated from the structure 1. The structure 1 can thus float freely in water, and be displaced, for example by towing, offshore, where it can be anchored by anchor lines 20 fastened to the anchor line fastening locations 5, as in the example illustrated in FIG. 9.

Although the present invention has been described with reference to specific exemplary embodiments, it is obvious that various modifications and changes can be made to these examples without departing from the general scope of the invention as defined by the claims. In addition, individual characteristics of the various exemplary embodiments mentioned can be combined in additional exemplary embodiments. Consequently, the description and drawings should be considered in an illustrative rather than restrictive sense.

The invention claimed is:

1. A method for launching a structure configured to float in water, comprising the steps of:

loading the structure on a pontoon floating in water, abutting under water at least one support pillar, connected to the structure, while the structure rests on the pontoon floating in water, lowering the pontoon, vertically disengaging the pontoon from the structure, while the structure is supported by the at least one support pillar bearing under water, before:

removing the pontoon while the structure is supported by the at least one support pillar bearing under water, and lowering the structure, still supported by the at least one support pillar, until the structure floats in water.

2. The launching method according to claim 1, wherein the at least one support pillar is removably connected to the structure, the method further including a step of separating the at least one support pillar from the structure once the structure floats in water.

3. The launching method according to claim 2, wherein the at least one support pillar is connected to the structure through a location for the fastening of an anchor line on the structure.

4. The launching method according to claim 1, further comprising a step of connecting the at least one support pillar to the structure before abutting under water the at least one support pillar.

5. The launching method according to claim 1, wherein the pontoon is lowered relative to a waterline of the pontoon during the pontoon lowering step.

6. The launching method according to claim 5, wherein the pontoon is ballasted to carry out the pontoon lowering step.

7. The launching method according to claim 1, wherein a level of the water goes down during the pontoon lowering step.

8. The launching method according to claim 7, wherein the tide lowers the level of the water during the lowering of the pontoon.

9. The launching method according to claim 1, wherein at least one vertical hydraulic and/or mechanical actuating cylinder is interposed between the at least one support pillar and the structure.

10. The launching method of claim 1, wherein the structure is a floating platform.

* * * * *